United States Patent [19]

Fawcett

[11] Patent Number: 4,724,566

[45] Date of Patent: Feb. 16, 1988

[54] POOL BRUSH TRASH TRAP AND COLLECTOR

[76] Inventor: William L. Fawcett, 9951 Fullbright Ave., Chatsworth, Calif. 91311

[21] Appl. No.: 906,990

[22] Filed: Sep. 15, 1986

[51] Int. Cl.[4] ..... E04H 3/20

[52] U.S. Cl. ..... 15/1.7; 15/160

[58] Field of Search ..... 210/169; 15/257.4, 257.6, 15/327, 321, 345, 257.2, 1.7, 160

[56] References Cited

U.S. PATENT DOCUMENTS

| | | | |
|---|---|---|---|
| 2,769,549 | 11/1956 | Bixby | 15/1.7 |
| 2,902,705 | 9/1959 | Eistrup | 15/246.5 |
| 3,063,077 | 11/1962 | Pansini | 210/169 |
| 3,368,686 | 2/1968 | Petrik | 210/407 |
| 4,003,100 | 1/1977 | Whitaker | 15/1.7 |
| 4,176,419 | 12/1979 | MacDonald | 15/1.7 |
| 4,348,281 | 9/1982 | Perry et al. | 210/169 |
| 4,481,117 | 11/1984 | Collins | 210/776 |

FOREIGN PATENT DOCUMENTS

| | | | |
|---|---|---|---|
| 578354 | 6/1946 | United Kingdom | 15/1.7 |
| 1590623 | 1/1976 | United Kingdom . | |

OTHER PUBLICATIONS

Hebor-Dichtungshutenfräsed-83 (Switzerland).

*Primary Examiner*—Edward L. Roberts
*Attorney, Agent, or Firm*—William H. Maxwell

[57] ABSTRACT

A swimming pool cleaning brush attachment or combination wherein a transparent window responds to water motion during brushing operations causing it to open for entry of debris into a net of bag configuration for collecting said debris when the window shuts in response to reverse water motion, the transparent window and open mesh net providing visibility therethrough for viewing the debris before and after its collection in the net.

12 Claims, 2 Drawing Figures

POOL BRUSH TRASH TRAP AND COLLECTOR

BACKGROUND OF THE INVENTION

This invention relates to pool cleaning and involves a trap and collector device used as an attachment to or in combination with a pool brush, preferably a pool cleaning brush at the end of a pole which is manipulated as may be required. State of the art pool cleaning brushes vary widely, all at the end of a pole or handle, and they have been equiped with debris collectors in the form of nets, bags and boxes, and with the provision for water circulation therethrough while entrapping debris. Also, trap doors have been used for debris entrapment within closed chambers, with the result that the collection of debris is obscured. With simple open netting visibility is impaired the least, but with the added prior art features such as the above mentioned trap doors and collection boxes and bags, visibility of debris before and after collection is greatly if not totally impaired. Therefore, it is an object of this invention to provide a Pool Brush Trash Trap and Collector which gives the manipulator a clear view of the debris before as well as after its collection. With the present invention, there is a transparent window trap through which the debris is washed by movement of the brush and through which the debris remains visible at all times. Also, the collector per se is a simple open mesh net that affords full view of what has been collected.

Debris collecting nets or bags or baskets or cages have been widely used for pool cleaning with and without brushes or scoops or scrapers and the like. It is a general object of this invention to use a net or bag or basket or cage as an attachment to or in combination with a brush or scoop or scraper and the like. As stated above, the combined members are transparent or see-through, and to the end that debris is visible ahead of the device before induction into the device, and is also visible after collection within the device. Hertofore, propellers and jets or syphons have been employed to induce movement of debris into collectors, however it is an object of this invention to establish natural induction as by means of forward motion of the device. Therefore, it is highly advantageous that the manipulator see through and ahead of the device in order to direct it properly. Induction of debris through the window trap and into the collector net is the result of the relative movement of masses, the debris and surrounding water in which it floats remaining substantially motionless, while the mass of the device penetrates forwardly through the water to embrace and/or enclose the relatively motionless debris.

It is preferred that the trap and collector be used as an attachment to or in combination with a pool cleaning brush at the end of a pole that is to be manipulated. Brushes of the type under consideration have a wide straight back from which the bristles project for scrubbing the pool bottom and side walls. The pole is rigid with the back of the brush to extend rearwardly and upwardly therefrom. In practice with this invention a window trap means is supported by and over the back of the brush , and collector means is supported by and over the pole. It is an object of this invention to correlate the window trap means and collector means with the brush and pole, whereby an extremely effective yet inexpensive device is made possible. Operation of the device is inherent upon normal operation of the brush, all without the use of spring means or any other mechanical device, the window trap means being a simple singular member pivoted within a frame that carries the collector means.

SUMMARY OF THE INVENTION

This invention advantageously uses mass inertia in a window trap through which the manipulator can see as his work progresses in cleaning a pool bottom and side walls. That is, the manipulator can see through the device. The said window trap is attached to a scrubbing brush by means of a frame that projects upwardly from the back of the brush. The brush is manipulated through a pole over which the collector in the form of an open mesh net lies. It is said frame that carries both the window trap and the collector, and through which debris ahead of and within the device is visible at all time, through the surrounding pool waters.

The foregoing and various other objects and features of this invention will be apparent and fully understood from the following detailed description of the typical preferred forms and applications thereof, throughout which description reference is made to the accompanying drawings.

THE DRAWINGS

PREFERRED EMBODIMENT

Figure 1:
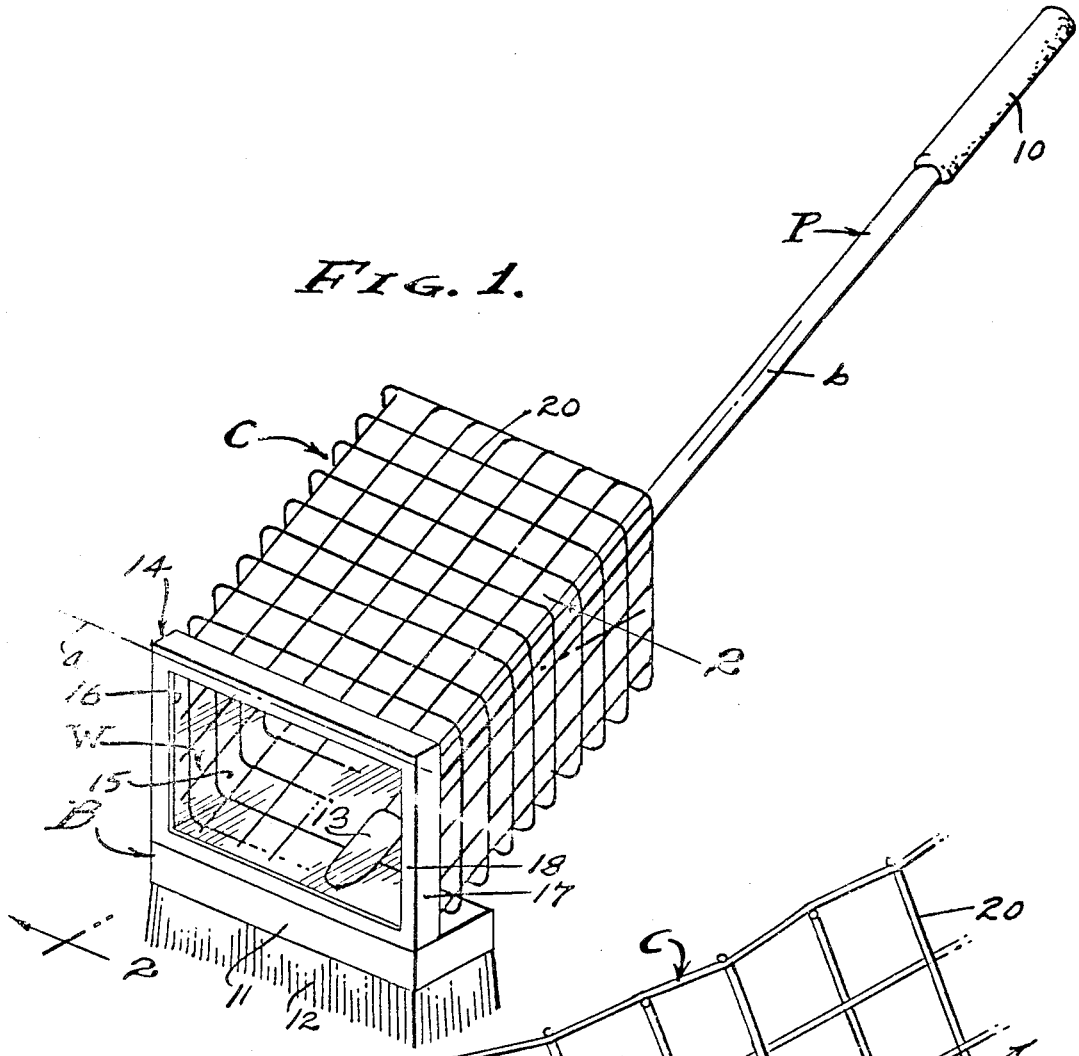
FIG. 1 is a perspective view showing the trash trap and collector as it is applied to a pool cleaning brush.
Figure 2:
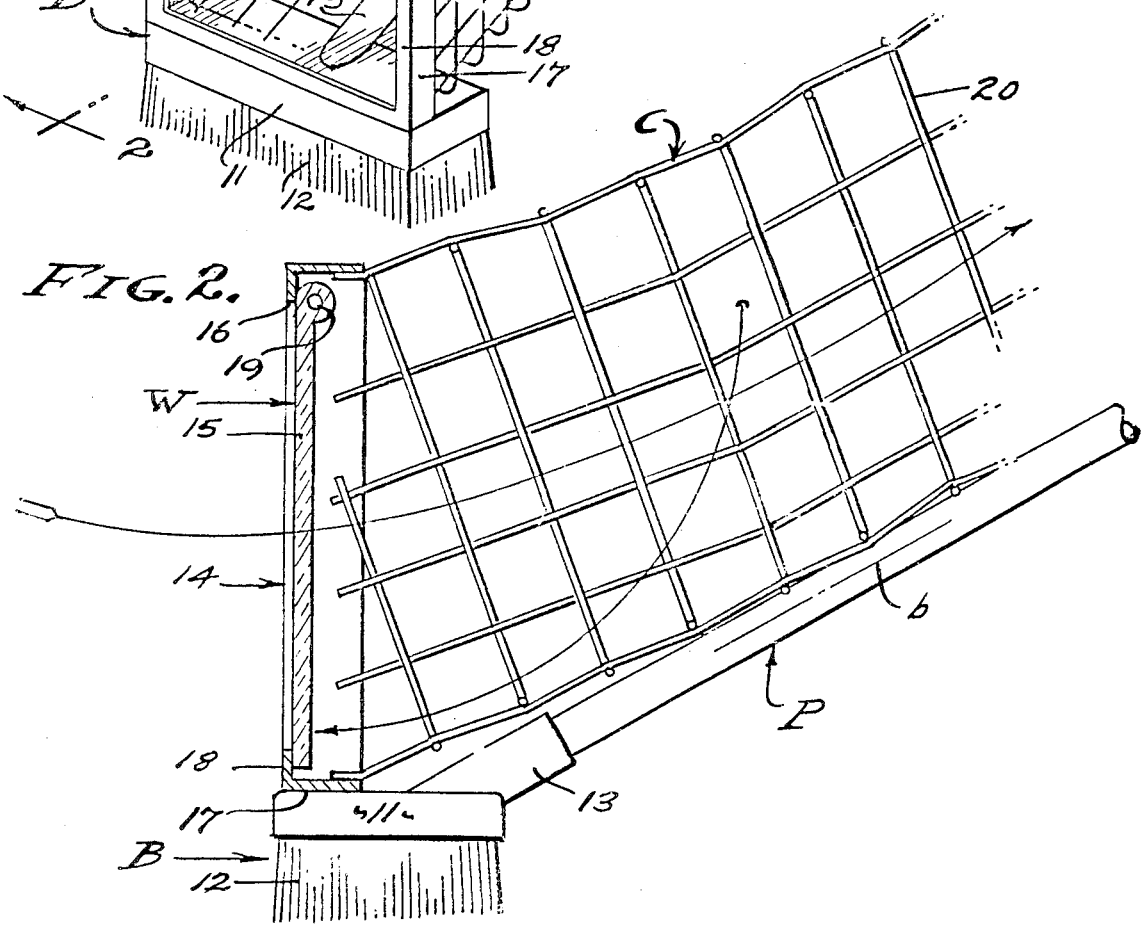
FIG. 2 is an enlarged longitudinal sectional view of the trash trap and collector attachment or combination with the pool ceaning brush taken as indicated by line 2—2 on FIG. 1.

Referring now to the drawings, I have shown a conventional pool cleaning brush rigidly attached to an extended pole P with a handle 10 at its remote end for manipulation. The brush B has a transversely elongated back 11 which is held spaced and parallel to the surface being scrubbed by means of bristles 12 projecting downwardly therefrom. The top of the back 11 is substantially unobstructed,although the center pole fitting 13 may encroach thereon in some brush constructions. A shown, the pole P and fitting 13 are on a rearwardly inclined axis b for convenience of manipulation at the water's surface while scrubbing at a substantial depth. Debris varies sidely and is most any solid substance which often settles and sticks to the bottom and side walls of the pool. Accordingly, the bristles 12 are relatively stiff and provide a firm guiding support for the brush B and window trap means W and collector means C that I will now describe.

The window trap means W is essentially a flap or check valve mounted over the brush B which can be operated as a "push-broom" or the like. Consequently, debris is pushed into the pool water ahead of the brush and said debris inherently rises as it is brushed loose. The window trap means W involves a frame 14, preferably of rectangular configuration within which a transparent window panel 15, of acrylic plastic, swings on a horizontally disposed axis a, above and parallel to the top of the brush 11.

The frame 14 is vertically disposed as shown in the drawings and forms an aperture 16 which the panel 15 closes when it hangs downward by gravity. However, open and closing of the aperture 16 is more positive as it is controlled by the mass inertia of rushing water in either direction. In practice, the frame 14 has a perimeter flange 17, the lowermost section of which is fastened to the top of the brush back 11, and has a coplanar inwardly and rearwardly faced seat flange 18 which forms the aperture 16. The window panel swings away from the back side of the seat flange 18 against which it seats when the window closes against the frame. Characteristically, the window 15 is free to swing on its pivot 19 and axis a, firstly to let water and debris force open the window in order to by-pass the same when moved forwardly, and secondly to swing shut against the seat flange 18 of the frame when moved rearwardly.

The collector means C is a loose net 20 of "purse" configuration, the open end of which is permanently attached to the perimeter flange 17, and shaped to overly the pole P to which it may or may not be attached, according to the its size and bulk of debris to be collected. In practice, the net 20 is of loose open flexible cord or filiment, having a grating less than the size of debris to be collected. The debris which by-passes the window W is trapped thereby within the net 20 and collected. However, it is a simple matter to open the window for discharge of the collected debris, whereby the device is reuseable as circumstances require.

From the foregoing it will be understood how this attachment to or combination with a pool cleaning brush inherently operates to fill the bag or net 20 with debris as forward motion thereof occurs. It is to be understood that a reciprocating brushing motion is employed in the usual manner, whereby debris is loosened from the pool surfaces and caused to float free in the pool water, whereupon forward motion of the device causes opening of the window trap W allowing the debris to float into and enter the confines of the net 20 for collection. When forward motion ceases, the window trap W falls shut by the action of gravity, or upon rearward motion of the device the rush of water causes the window trap W to forceably shut. The manipulator can always see around the pole P and brush B, and he can easily see through the aperture 16 of the frame F. And, the aforesaid visibility is not lost by the presence of the transparent window trap W nor by the open mesh net 20, both of which permit viewing of the debris before and after its collection.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. In combination with a pool cleaning brush having a transversely elongated back and bristles projecting downwardly therefrom;

a vertically disposed frame carried over the back of the brush and having an aperture for water flow therethrough and over the brush, a trap means carried by the frame to open and to close the aperture and comprised of a swinging panel normally hanging against a stop seat surrounding the aperture in the frame, and a collector means carried by the frame at an opening side of the frame aperture to receive floating debris when the trap means is open and to confine the debris when the trap means is closed.

2. The combination with a pool cleaning brush as set forth in claim 1, wherein the swinging panel of the trap means depends from a horizontal pivot and axis in the frame and normally engaged against the stop seat surrounding the aperture in the frame.

3. The combination with a pool cleaning brush as set forth in claim 1, wherein the collector means is a bag with an opening attached to the frame surrounding the aperture therein and into which the trap means opens.

4. The combination with a pool sleaning brush as set forth in claim 1, wherein the swinging panel of the trap means depends from a horizontal pivot and axis in the frame and normally engaged against the stop seat surrounding the aperture in the frame, and wherein the collector is a bag with an opening attached to the frame surounding the aperture therein and into which the trap means opens.

5. In combination with a pool cleaning brush having a transversely elongated back and bristles projecting downwardly therefrom;

a vertically disposed frame carried over the back of the brush and having an aperture for both the flow of water over the brush and visibility therethrough, a transparent window trap means carried by the frame to open and close the aperture for water flow and stoppage with continued visibility therethrough and comprised of a swinging panel of transparent material normally hanging against a stop seat surrounding the aperature in the frame, and a see-through collector means carried by the frame at an opening side of the frame aperture to receive floating debris when the trap means is open and to confine the debris therein when the trap means is closed.

6. The combination with a pool cleaning brush as set forth in claim 5, wherein the swinging panel of the trap means of transparent material depends from a horizontal pivot and axis in the frame and normally engaged against the stop seat surrounding the aperture in the frame.

7. The combination with a pool cleaning brush as set forth in claim 5, wherein the collector means is an open mesh net for visibility and with an opening attached to the frame surrounding the aperture therein and into which the trap means opens.

8. The combination with a pool cleaning brush as set forth in claim 5, wherein the swinging panel of the trap means is of transparent material depending from a horizontal pivot and axis in the frame and normally engaged against a stop seat surrounding the aperture in the frame, and wherein the collector means is an open mesh net for visibility and with an opening attached to the frame surrounding the aperture therein and into which the trap means opens.

9. In combination with a pool cleaning brush at the end of a rearwardly extending pole and having a transversely elongated back and bristles projecting downwardly therefrom;

a vertically disposed frame carried over the back of the brush and having an aperture for both the flow of water over the brush and visibility therethrough, a transparent window trap means carried by the frame to open and close the aperture for rearward water flow and stoppage thereof and with continued visibility therethrough and comprised of a rearwardly swinging panel of transparent material normally hanging against a rearwardly disposed stop seat surrounding the aperture in the frame, and a see-through collector means carried by the frame at an opening rearward side of the frame aperture and extending rearwardly to overly the pole and to receive floating debris when the trap means is open and to confine the debris therein when the trap means is closed.

10. The combination with a pool cleaning brush as set forth in claim 9, wherein the swinging panel of the trap means is rearwardly swinging and of transparent material depending from a horizontal pivot and axis in the frame and normally engaged against the stop seat disposed rearwardly and surrounding the aperture in the frame.

11. The combination with a pool cleaning brush as set forth in claim 9 wherein the collector means is an open mesh net for visibility and with an opening attached to the frame surrounding the aperture therein and into which the trap means opens rearwardly.

12. The combination with a pool cleaning brush as set forth in claim 9, wherein the swinging panel of the trap means is rearwardly swinging and of transparent material depending from a horizontal pivot and axis in the frame and normally engaged against a rearwardly disposed stop seat surrounding the aperture in the frame, and wherein the collector means is an open mesh net for visibility and with an opening attached to the frame surrounding the aperture therein and into which the trap means opens rearwardly.

* * * * *